US005164206A

United States Patent [19]

Cargille

[11] Patent Number: 5,164,206

[45] Date of Patent: Nov. 17, 1992

[54] TOOLING FACE CONFIGURATION-PARTICULARLY ADAPTED FOR FORMING TABLETS (CARGILLE CURVE)

[76] Inventor: John J. Cargille, 5 Crane Rd., Mountain Lakes, N.J. 07046

[21] Appl. No.: 730,565

[22] Filed: Jul. 15, 1991

Related U.S. Application Data

[63] Continuation of Ser. No. 386,636, Jul. 31, 1989, abandoned.

[51] Int. Cl.[5] ..... B28B 3/02

[52] U.S. Cl. ..... 425/352; 424/464; 425/412; 264/109; 264/123; 249/175

[58] Field of Search ..... 264/109, 399, 123; 425/193, 298, 406, 380, 381, 467, 353, 408, 411; 424/464

[56] References Cited

U.S. PATENT DOCUMENTS

| | | | |
|---|---|---|---|
| 2,965,946 | 12/1960 | Sweet et al. | 425/353 |
| 3,534,440 | 10/1970 | Roberts | 425/411 |
| 3,737,276 | 6/1973 | Hill et al. | 425/406 |
| 4,401,614 | 8/1983 | DeSantis | 425/411 |
| 4,408,975 | 10/1983 | Hack | 425/353 |
| 4,789,324 | 12/1988 | Akhavi | 425/469 |
| 4,890,998 | 1/1990 | Grabener | 425/411 |
| 4,946,634 | 8/1990 | Shaner | 264/109 |

*Primary Examiner*—Thurman K. Page
*Assistant Examiner*—Raj Bawa
*Attorney, Agent, or Firm*—Arthur L. Plevy

[57] ABSTRACT

There is disclosed a tooling (punch) face for pressing chemical tablets which essentially comprises a central flat area of about 75% of the outer diameter of the tool surrounded by a peripheral radial area or arcuate area which comprises about 25% of the outer diameter of the tool. The tool face is such that it enables a conformed tablet to be fabricated utilizing the tool surface whereby one can employ powdered chemical compositions and virtually eliminate excipients.

7 Claims, 1 Drawing Sheet

TOOLING FACE CONFIGURATION-PARTICULARLY ADAPTED FOR FORMING TABLETS (CARGILLE CURVE)

This is a continuation of application Ser. No. 07/386,636 filed on Jul. 31, 1989 now abandoned.

BACKGROUND OF THE INVENTION

This invention relates to the formation of tablets for the chemical industry and more particularly to a tooling face particularly adapted to form a tablet by minimizing or eliminating excipients.

As one can ascertain, tablets are available widely in both the chemical and pharmaceutical industries. Such tablets, for example, incorporate various chemicals, pharmaceuticals and so on and are utilized for various purposes. Essentially, a major difference between tablets for internal consumption and chemical tablets is that the human body can stand non-toxic and inert fillers and excipients which become contaminants in chemical applications.

For example, in chemical tabletting one may form tablet products for water testing or purification, products for dissolving sanitizers and neutralizers in water and various other chemical products. These products are not intended for internal consumption and essentially are designated as chemically reactive tablets. Preferably these chemical tablets should be free of fillers and excipients which can become contaminants in chemical applications as they can react or otherwise form deleterious and/or contain insoluble substances. Such excipients, which are widely used in the tabletting industry, include starch, cellulose, mineral oil, gums as gum Arabic, polyethylene glycols, sodium stearate, magnesium stearate and other materials which help in the tabletting process.

Essentially, tablets are formed by compressing free flowing powders or granules using conventional tablet presses, such as those manufactured by Vector of Iowa, Stokes of Pennsylvania and so on. Such tablet presses serve to compress the material to form a tablet, the shape of which is determined by the shape of the tooling. The normal excipients used are the above-noted materials which eliminate many problems in regard to the tablet such as the binding of machine parts, sticking, picking, tablet capping and lamination and other interference with machine operation and quality of the tablet.

In any event, one usually adds excipients to provide a reliable and uniform tablet. Such chemicals when contained in tablets as indicated can become contaminants. Hence, in chemical applications there is a severe restraint on the excipients that can be used and often a tablet must be created using no additives but utilizing the powdered chemical formulation by itself.

In order to provide tablets, the prior art has employed standard IPT shapes. Thus normal tablet shapes are described in the Tabletting Specification Manual of the Industrial Pharmaceutical Technology Section (IPT) of the Academy of Pharmaceutical Sciences, American Pharmaceutical Association (1981). That publication describes punch tips or tool faces which are generally designated as shallow concave, standard concave, deep concave, extra deep, modified ball and flat face beveled edge.

Generally, flat faced tablets are often made in a manufacturing process and are called slugs. When one employs the standard IPT shapes, as indicated above, one can experience many problems. Certain of the problems are inherent in that chemical formulations, which are typical in chemical applications, have poor internal flow under pressure and create "capping" and "lamination" problems which are normally overcome by the addition of excipients which are undesirable, as indicated above.

The alternative approach is the so-called flat face or slug, as above indicated. The flat face approach creates a cylinder, in the case of round tablets, having a completely flat top. The flat face therefore has a sharp edge or a right angle that is vulnerable to deformation and chipping that substantially affects the tablet appearance (shop worn) and further effects the tablets integrity and weight and generates particles and powders from tumbling or ejection from the tablet press and from normal attrition in packaging, and other processing techniques and transit.

Hence the next standard alternative is to employ the bevel edge configuration which resembles the flat face tool but has a small angle or bevel at the edge that avoids the sharp square edges of the flat face. The disadvantage is that the angle where the bevel meets the flat portion of the tablet face provides a corner where "sticky" formulations are not removed completely when the tablet is ejected from the tablet presses. Once sticking starts all the following tablets have a deformed or imperfect appearance. The sticking of course is inherent in the fact that "sticky" chemical formulation would cause adhesion to the associated tool or die.

It is therefore an object of the present invention to provide a tooling face which can be employed in a tablet press and manufacture many chemical tablets without the use of excipients.

It is a further object to provide chemical and industrial tablets relatively eliminating excipients by providing a tablet tooling face which has a substantial flat face surrounded by a smooth flange-like peripheral portion of a given radius or curve.

SUMMARY OF THE INVENTION

In a tool for insertion into a tablet press for forming tablets from powdered chemical compositions by pressing the tool face against the powdered compositions, the improvement therewith of a tool face comprising a depressed circular central flat surface surrounded by a peripheral depending flange of a given radius, with said central flat surface located a given distance below the outermost edge of said flange, with said tool face of said given outer diameter having said central flat surface of a specified percentage of said outer diameter, with said given distance of another percentage of said outer diameter and with said radius of another percentage of said outer diameter.

DETAILED DESCRIPTION OF THE FIGURES

Figure 1:
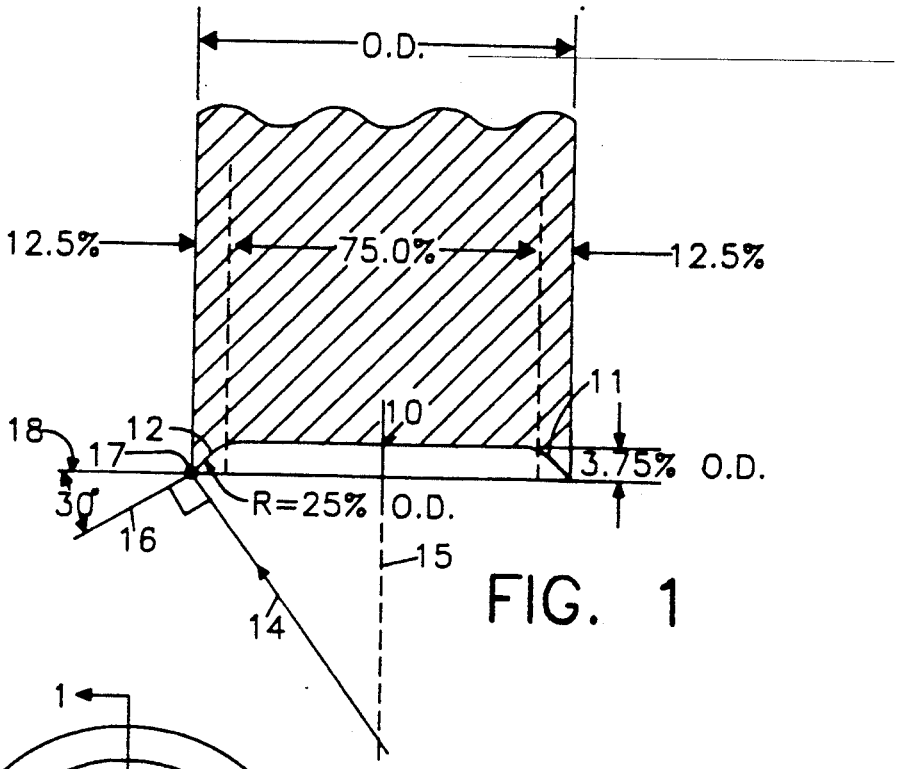
FIG. 1 is a cross-sectional view taken through line 1—1 of FIG. 2.
Figure 2:
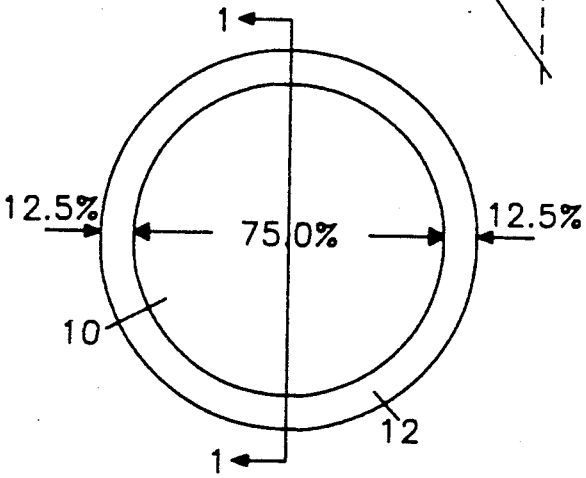
FIG. 2 is a front end view of a tool face configuration according to this invention.

Referring to FIG. 1 there is shown a cross-sectional view taken through a punch as depicted in the bottom plan view in FIG. 2. The tool is partly depicted to mainly show the tool face in cross section. Essentially the tool is cylindrical in shape and has a tooling face which is characterized as follows. The tooling face has a substantial flat section 10 which provides a flat face across the tool which terminates peripherally in a depending smooth flange having a given radius or curve denoted as 11 and 12 of FIG. 1. The tool has an angle of 30° from the flat area, which is the tablet face, as shown in FIG. 1. The angle of 30° is first determined as follows. The line 14 intersects the line 15 which is the center line of the flat face 10 and is also the center line of the tool face. The line 16 is drawn at a right angle to line 14 at point 17. The line 18 is parallel to the face 10 at point 17 and the angle at point 17 of 30° is defined. The flat area is 75% of the punch outer diameter (O.D.) with the curved radius portion being 25% of the tablet outer diameter, as for example 12.5% for portion 11 and 12.5% for portion 12. As seen in FIG. 1, the curved area covers 25% of the total outer diameter of the punch and therefore 25% of the total outer diameter of the tablet. The transition from portion 12 to the flat section 10 is completely smooth and continuous leaving no abrupt or stepped transitions and provides a smooth surface while minimizing the required flow of powders under compression. The tooling or punch face is referred to as the "Cargille Curve" due to its unique nature and attributes.

As seen in FIG. 2, the tool face has the flat section 10 which is surrounded by the peripheral curved area of the portion 12. The depth of the tool is equivalent to 3.75% of the outer diameter. In a typical example, for a 2 inch tablet the flat section 10 would be 1.5 inches. The radius of the peripheral area curve would be 0.5 inches and the depth would be 0.075 inches. The width of the sections 11 and 12, which are encompassed within the curve, are each 0.25 inches, therefore, specifying a tablet with 2 inches outer diameter and any desired thickness, as shown in FIG. 3.

Figure 3:
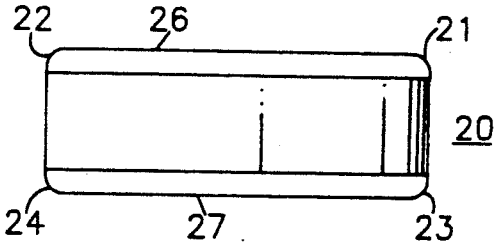
FIG. 3 is a side plan view of a tablet formed by employing a tool face according to this invention.

Referring to FIG. 3, there is shown a tablet formed utilizing the tool face as indicated above. The tablet 20 has a curved peripheral edge 21 and 22 on the top and a curved edge 23 and 24 on the bottom. These edges are completely congruent and symmetrical and surrounds the flat face portion of the tablet. The tablet further has an extensive top flat portion 26 and an extensive flat bottom portion 27. The tablet is formed in a tablet press by utilizing a tool face, as shown in FIG. 1.

Figure 4:
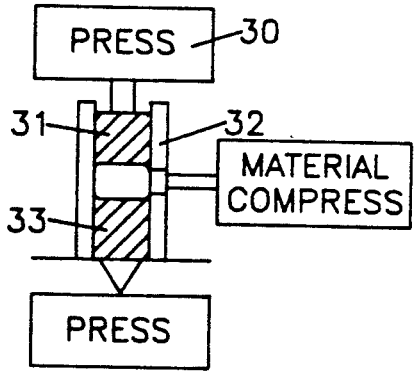
FIG. 4 is a simple schematic diagram of a typical tabletting press operation.

Referring to FIG. 4, a typical tablet press operation is simply shown. The press, for example, has the upper punch 31 with the tool face of FIG. 1 secured to a ram or other activating device 30. The tool 31 may be positioned within the die 32, which die also contains a lower punch face 33 having the same curved surface as the punch face 31 with its own activation system. Material from a hopper is filled into the die cavity 32 by a feed shoe and the punches are activated to compress the tablet as shown in FIG. 3. (Hopper and shoe are not shown).

As one can ascertain, the tablet forming station shown in FIG. 4 consists of an upper punch 31 and a lower punch 33 and a die 32. The punch determines the shape of the face of the tablet, the die determines the outer diameter (od) or shape of the cross section of the tablet.

Based on the above described curves, one does not need high pressure flow lubrication in material and therefore one can produce tablets by utilizing fewer excipients. The size of the tablet is a function of the size of the tooling and tablets can be produced having dimensions ranging from 1/16th of an inch to 4½ inches. In this manner the tool face, as above indicated, can be employed for all sizes in this range as well as other sizes if larger presses are available. The above dimensions, in conjunction with the drawings, are preferable and essentially the tool face is primarily a flat face with a radius or curve at the edge. The tool has an angle of 30° from the flat area, which is the tablet face, and the flat area is 75% of the tablet outer diameter with the curve radius being 12.5% of the tablet outer diameter at both sides or a total of 25% of the tablet outer diameter.

By utilizing such a tool face, one avoids or minimizes the use of required excipients for good tablets. The tool face further eliminates the corner as would appear in flat face bevel edge tablets which would induce sticking and hence result in improper tablet formation. The tool face further eliminates the sharp edges on flat face tablets that is sensitive to the nicking and chipping that effects tablet appearance, tablet integrity and weight while further generating chips and powders that remain loose within the package.

The tool face enables the tablet to be ejected smoothly from the tablet press and utilizing this curve one can make many border line formulations tablet without using fillers and excipients. This tool face design makes certain problem formulations capable of being tabletized and hence provides unique results as compared to prior art tool face designs. Such formulations include powders containing trichloroisocyanuric, soda ash, surfactants, waxes, plastics and other materials used in chemical applications utilizing "sticky" formulations.

Figure 5:
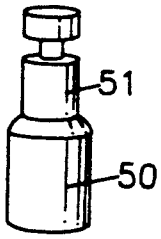
FIG. 5 is a view of a typical tool having a tool face configuration according to this invention.

FIG. 5 depicts a typical tool 50 having the tool face of FIG. 1 and including a shank or shaft 51 for insertion into a typical press. The exact shape of the tool is not critical and many alternate embodiments can be envisioned.

While the above-noted dimensions are completely preferably, it is envisioned that the angle and radius can be modified. Typically the angle can range between 10°–60° and the radius 10–50% of the punch diameter. The unique shaped tool face can be used in many types of powder compacting presses, as for example powder metallurgy, ceramics, pharmaceutical, plastic preform and so on. It can also be used on mechanical, hydraulic, ultrasonic, pneumatic and other type presses. It is the main aspect of the tool configuration shown which enables the elimination of excipients by minimizing side-to-side flow under pressure and avoiding the utilization of flat face tablets. For simplicity, only circular tablets are discussed above. Other shapes can be accommodated such as capsular, triangular, square and other shapes as well. The principles of this tooling face could be applied to these other shapes as desired.

I claim:

1. In a tablet press tool for forming tablets from powdered compositions by pressing a circular tool face, having an outside face diameter of between 1/16th of an inch and 4½ inches, against the powdered composition; an improved tool face comprising:

a recessed circular flat surface coaxially positioned on said tool face and having a surface diameter equivalent to approximately 75% of said face diameter, said flat surface surrounded by a peripherally depending flange extending between said surface diameter and said face diameter, said flange having a radius of curvature that is between 10% and 50% of said face diameter, wherein said flange terminates at said face diameter at an acute angle of between 10 degrees and 60 degrees relative said flat surface and said flat surface is recessed a depth equivalent to approximately 3.75% of said face diameter below the position of said flange at said face diameter.

2. The tool face of claim 1 wherein said acute angle is 30 degrees.

3. The tool face of claim 1 wherein said flat surface is between 0.047 inches and 3.380 inches in diameter.

4. The tool face of claim 3 wherein said flat surface is recessed a depth of between 0.0023 inches and 0.169 inches.

5. The tool face of claim 4 wherein said radius is between 0.006 inches and 2.25 inches.

6. The tool face of claim 5 wherein said flange is symmetrically deposed around said flat surface forming 25% of said face diameter.

7. The tool face of claim 6 wherein said flange is between 0.016 inches and 1.125 inches in width.

* * * * *